US007695129B2

(12) United States Patent
Yoshikawa et al.

(10) Patent No.: US 7,695,129 B2
(45) Date of Patent: Apr. 13, 2010

(54) RECORDING APPARATUS AND RECORDING METHOD

(75) Inventors: Junichi Yoshikawa, Tokyo (JP); Kenji Kawazoe, Yokohama (JP); Katsuyuki Yokoi, Yokohama (JP); Tetsuyo Ohashi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 355 days.

(21) Appl. No.: 11/443,177

(22) Filed: May 31, 2006

(65) Prior Publication Data

US 2006/0274102 A1 Dec. 7, 2006

(30) Foreign Application Priority Data

Jun. 7, 2005 (JP) ..... 2005-166675

(51) Int. Cl.
*B41J 2/01* (2006.01)

(52) U.S. Cl. ..... 347/104; 347/16; 347/5; 347/14

(58) Field of Classification Search ..... 347/104, 347/101, 14, 19, 5, 16; 400/703, 642; 399/411
See application file for complete search history.

(56) References Cited

U.S. PATENT DOCUMENTS 4,780,740 A * 10/1988 Fukae ..... 399/86
5,109,236 A 4/1992 Watanabe et al. ..... 346/76 PH
5,366,301 A * 11/1994 Martin et al. ..... 400/56
7,192,207 B2 3/2007 Ohashi et al. ..... 400/188
7,222,955 B2 5/2007 Ohashi et al. ..... 347/104
7,347,637 B2 * 3/2008 Kubo et al. ..... 400/624
2004/0207708 A1 10/2004 Ohashi et al. ..... 347/104
2005/0111015 A1 * 5/2005 Tsujimoto ..... 358/1.9
2005/0270354 A1 * 12/2005 Taguchi et al. ..... 347/104
2006/0045601 A1 * 3/2006 Endo ..... 400/642

* cited by examiner

*Primary Examiner*—Manish S Shah
(74) *Attorney, Agent, or Firm*—Fitzpatrick, Cella, Harper & Scinto

(57) ABSTRACT

The invention is to provide a recording apparatus and a recording method, capable of automatically specifying a type of a recording medium by a simple and inexpensive structure, thereby automating a sheet type setting operation and avoiding an error of user in such sheet type setting operation. The apparatus is equipped with first detectors for detecting a width dimension of a recording medium, a second detector for detecting a surface characteristic of the recording medium, and a discriminator for discriminating the type of the recording medium based on the results of the first and second detectors.

4 Claims, 9 Drawing Sheets

FIG. 7

| MEDIUM TYPE | WIDTH | LENGTH | PLAIN PAPER | COATED PAPER | GLOSSY PAPER | OHP | SENSOR | | | GROUP |
|---|---|---|---|---|---|---|---|---|---|---|
| | | | | | | | 32 | 33 | 34 | |
| BUSINESS CARD, CARD | 55 | 91 | | ● | | | 0 | 0 | 0 | D |
| L | 89 | 127 | | ● | ● | | 0 | 0 | ON | C |
| ENVELOPE (PORTRAIT TYPE NO. 4) LENGTH | 90 | 205 | ● | | | | 0 | 0 | ON | C |
| ENVELOPE (LANDSCAPE TYPE NO. 3) LENGTH | 98 | 148 | ● | | | | 0 | ON | 0 | B |
| ENVELOPE (LANDSCAPE TYPE NO. 6) LENGTH | 98 | 190 | ● | | | | 0 | ON | 0 | B |
| POSTCARD | 100 | 148 | ● | ● | ● | | 0 | ON | 0 | B |
| 4×6 | 101.6 | 152.4 | | ● | ● | | 0 | ON | 0 | B |
| #10 ENVELOPE LENGTH | 104.8 | 241.3 | ● | | | | 0 | 0 | 0 | D |
| ENVELOPE (LANDSCAPE TYPE NO. 4) LENGTH | 105 | 235 | ● | | | | 0 | 0 | 0 | D |
| DL ENVELOPE LENGTH | 110 | 220 | ● | | | | 0 | 0 | 0 | D |
| ENVELOPE (LANDSCAPE TYPE NO. 2) LENGTH | 114 | 162 | ● | | | | 0 | 0 | 0 | D |
| ENVELOPE (LANDSCAPE TYPE NO. 1) LENGTH | 120 | 176 | ● | | | | 0 | 0 | 0 | D |
| ENVELOPE (PORTRAIT TYPE NO. 3) LENGTH | 120 | 235 | ● | | | | 0 | 0 | 0 | D |
| 2L | 127 | 178 | | ● | ● | | 0 | 0 | 0 | D |
| 5×7 | 127 | 177.8 | | ● | ● | | 0 | 0 | 0 | D |
| A5 | 148 | 210 | ● | ● | | | 0 | 0 | 0 | D |
| B5 | 182 | 257 | ● | ● | | | 0 | 0 | 0 | D |
| DOUBLE POSTCARD | 200 | 148 | ● | | | | 0 | 0 | 0 | D |
| A4 | 210 | 297 | ● | ● | ● | ● | ON | 0 | 0 | A |
| LETTER | 215.9 | 279.4 | ● | ● | ● | ● | ON | 0 | 0 | A |

RECORDING APPARATUS AND RECORDING METHOD

BACKGROUND OF THE INVENTION

1. Field of the Invention

The present invention relates to a recording apparatus and a recording method provided with judgment means which automatically identifies a type of a recording medium.

2. Related Background Art

A recording apparatus in a printer, a facsimile apparatus, a copying apparatus, or a composite equipment or system including the same records an image on a recording medium such as a recording paper sheet based on image information, and is based on various recording methods such as an ink jet recording system, a laser beam system or a thermal transfer system. Such recording apparatuses are recently faced with an increasingly stronger request for a higher definition in image formation, and, for example in an ink jet recording apparatus, particularly in a color ink jet recording apparatus, executing an image recording by discharging inks, there is required an image formation comparable, in image clarity and image quality, to a silver halide-based photograph. A finer particle formation in the discharged ink and a more exact ink discharge are necessary for meeting such requirement, but improvements are also necessitated in the recording medium.

Among the recording media, those having various surface states (surface characteristics) such as a glossy surface, a semi-glossy surface and a matted (non-glossy) surface have been developed for reproducing an image texture of silver halide-based photographs, and the user can now select these recording media according to the taste. In addition to such photo-like recording media, the recording is also executed on a plain paper, a coated paper, a postcard, an ink jet-purpose postcard, an OHP film and the like, and the system of the recording apparatus is required to selectively adapt to such recording media.

In general, the recording media often show, depending on the material coated on the surface, difference in a color developing state and an ink absorbing state. For this reason, it is often conducted to optimize an image color processing and an ink deposition amount according to the type of the recording medium, in order to record a satisfactory image. The selections for such optimization are executed on a printer driver, stored in a host computer connecting to the recording apparatus. However, the selection of the recording medium to be used is done by the user, and it is necessary for the user, at the printing operation, to execute an operation, on a display image screen of the printer driver, of selecting the type of the recording medium on which the recording is to be made.

Also the recording apparatuses are becoming to be used in diversified methods, such as, in addition to the use by connecting to a host computer, a direct connection to a digital camera and a printing by a direct insertion of a memory card. Also in such cases, there are required input operations for the size and the type of the recording medium to be used by the user, in the same manner as in the case of connection to the host computer. Since such operations are cumbersome and often result in an error when executed by an unskilled user, a recording apparatus equipped with detection means which automatically judges the recording medium is recently developed. As disclosed in U.S. Pat. No. 5,109,236, an optical sensor is principally utilized as the detection means.

In the prior recording apparatus, however, it is insufficient, for obtaining a print of a desired image quality, merely to judge the recording medium by receiving a detection result signal form the detection means and to execute a printing by optimizing the image color process and the ink deposition amount based on such result. The user is required to input a size of the recording medium on an image of an application or a printer driver, and also to simultaneously set the recording medium of a matching size on a sheet feeding unit. Otherwise, the printing area does not match the recording medium in size, but overflows from or is excessively smaller than the recording medium. Such size entering operation is also cumbersome for an unskilled user and often result in a mismatching of the image and the recording medium in size.

SUMMARY OF THE INVENTION

An object of the present invention is to provide a recording apparatus and a recording method, capable of automatically specifying a type of a recording medium by a simple and inexpensive configuration, thereby avoiding an operation error of the user in setting the medium type by such automated medium type setting.

Another object of the present invention is to provide a recording apparatus for executing a recording on a recording medium by recording means based on recording information, the apparatus including sheet feed means which feeds the recording medium in a stacking portion, first detection means which detects a width dimension of the recording medium in the stacking portion, second detection means which detects a surface characteristic of the recording medium in the stacking portion, and discrimination means which discriminates the type of the recording medium, based on the detection results of the first and second detection means.

Still another object of the present invention is to provide a recording method for executing a recording operation on a recording medium by recording means based on recording information, the method including a first detection step of detecting a width dimension of the recording medium in a stacking portion, a second detection step of detecting a surface characteristic of the recording medium in the stacking portion, and a discrimination step of discriminating the type of the recording medium, based on the detection results of the first and second detection steps.

BRIEF DESCRIPTION OF THE DRAWINGS

FIG. 7 is a table showing an example of a relationship among a size, a surface state, and a type of the recording medium;

DETAILED DESCRIPTION OF THE PREFERRED EMBODIMENTS

Figure 1:
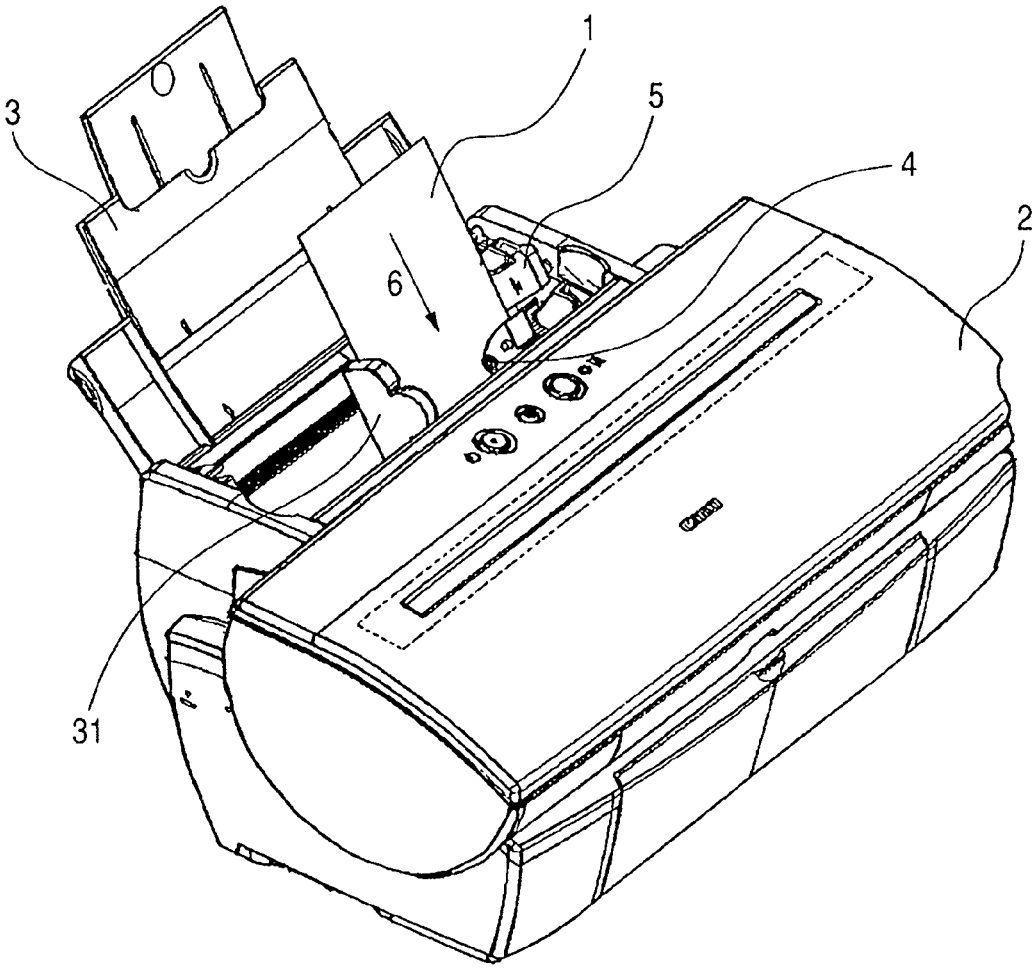
FIG. 1 is a perspective view of a recording apparatus in an embodiment.

In the following, the present invention will be clarified by an embodiment thereof, with reference to the accompanying drawings. Throughout the drawings, like numbers or symbols indicate same or equivalent parts. FIG. 1 is a perspective view of a recording apparatus in an embodiment. This embodiment shows a case where the recording apparatus is an ink jet recording apparatus, that is, a case where recording means (recording head) for forming an image based on image information is ink jet recording means which executes a recording by discharging ink from a discharge port onto a recording medium. Referring to FIG. 1, in response to a command for starting a recording operation, recording media 1, which are sheet members such as papers or plastic sheets, and are stacked on a sheet feeding tray (stacking portion) 3 of a sheet feeding portion 5, are separated one by one, by means of sheet feed means such as a sheet feed roller 21 (cf. FIG. 2), and fed in an arrow 6 direction toward a recording portion 2.

The sheet feed portion is equipped with first detection means which detects a width dimension of the recording medium in the stacking portion, and second detection means which detects a surface characteristic of the recording medium in the stacking portion. More specifically, above the stacked recording media, there is provided a sheet type sensor 4 constituting the second detection means for detecting and identifying surface characteristic (surface state) of the stacked recording media. The stacking portion is also equipped with a movable side guide 31, that can be manipulated by the operator. The side guide 31 is provided for restricting a lateral edge of the recording medium in the stacking portion. In the present embodiment, a position of the side guide 31 can be detected by positions sensors 32, 33, 34 (FIG. 5) to be explained later. Such positions sensors constitute the first detection means for detecting the width dimension of the recording medium.

The type of the recording medium is discriminated based on the width dimension of the recording medium 1 and the detection results of the surface characteristic, obtained from such sheet type sensor 4 and the position sensors 32, 33 and 34. A recording portion 2 is equipped with a recording head, constituting recording means which executes a recording operation on the recording medium based on recording information. In a position opposed to the recording head, there is provided a platen for guiding and supporting the recording medium. A conveying roller and a pinch roller, constituting main conveying means, are provided at an upstream side of the platen, and a sheet discharge roller and a spur are provided at a downstream side of the platen.

The recording medium 1, fed by sheet feed means such as a sheet feed roller, is subjected to a recording operation by the recording head while being conveyed on the platen by means of the conveying roller and the sheet discharge roller that are driven in synchronization, and the recording medium after recording is discharged through the sheet discharge roller for example to a sheet discharge tray, which is provided outside the main body of the apparatus. In such recording operation, the type of the recording medium is discriminated based on the width dimension of the recording medium detected by the positions sensors 32, 33, 34 and the surface characteristic thereof detected by the sheet type sensor 4, whereby the recording portion 2 is enabled to automatically and securely execute a recording operation under optimum conditions for the recording medium.

Figure 2:
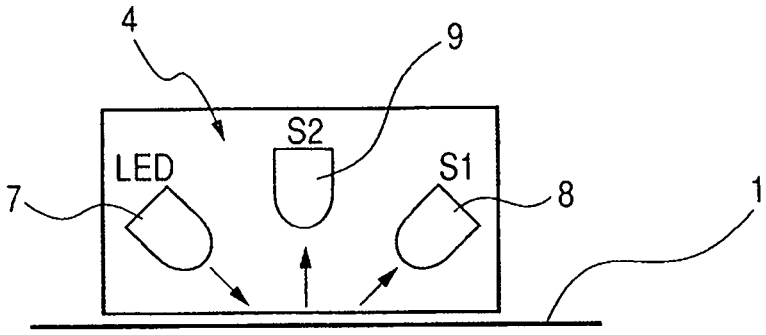
FIG. 2 is a schematic view of a sheet type sensor in the recording apparatus shown in FIG. 1.

FIG. 2 is a schematic view of the sheet type sensor 4 in the recording apparatus shown in FIG. 1. In the sheet type sensor 4, as shown in FIG. 2, a light-emitting element (LED) 7 projects a light obliquely onto a surface of the recording medium such as a recording sheet, then a reflected light from the surface of the recording medium is received by two photosensors 8 (S1) and 9 (S2), and the surface characteristic of the recording medium is detected by the light amounts respectively received by the photosensors S1 and S2. The type of the recording medium can be easily and securely discriminated from the detection result of the surface characteristic of the recording medium and that of the width of the recording medium, as will be explained later.

The recording media include various types such as a glossy surface, a semi-glossy surface, a matted (non-glossy) surface, a plain paper, a coated paper, a postcard, an ink jet-recording postcard, and an OHP sheet, and the surface characteristics are different depending on such types. Also the light amounts respectively received by the photosensors S1 and S2 change depending on such types. It is therefore possible, from the information obtained from the characteristics in the change of the light amounts, to discriminate the type (surface state) of the recording medium. The present embodiment explains, for the purpose of simplicity, an example of classifying the recording media into four categories of plain paper, coated paper, glossy paper and OHP sheet. However, the present invention is not limited to such case, but includes also a case of discrimination into finer classes such as a coated paper 1, a coated paper 2, a glossy paper 1, a glossy paper 2, a postcard 1 and a postcard 2. Also the surface characteristic detection for the recording medium is not limited to the optical type described above but may also be executed by other methods.

Figure 3:
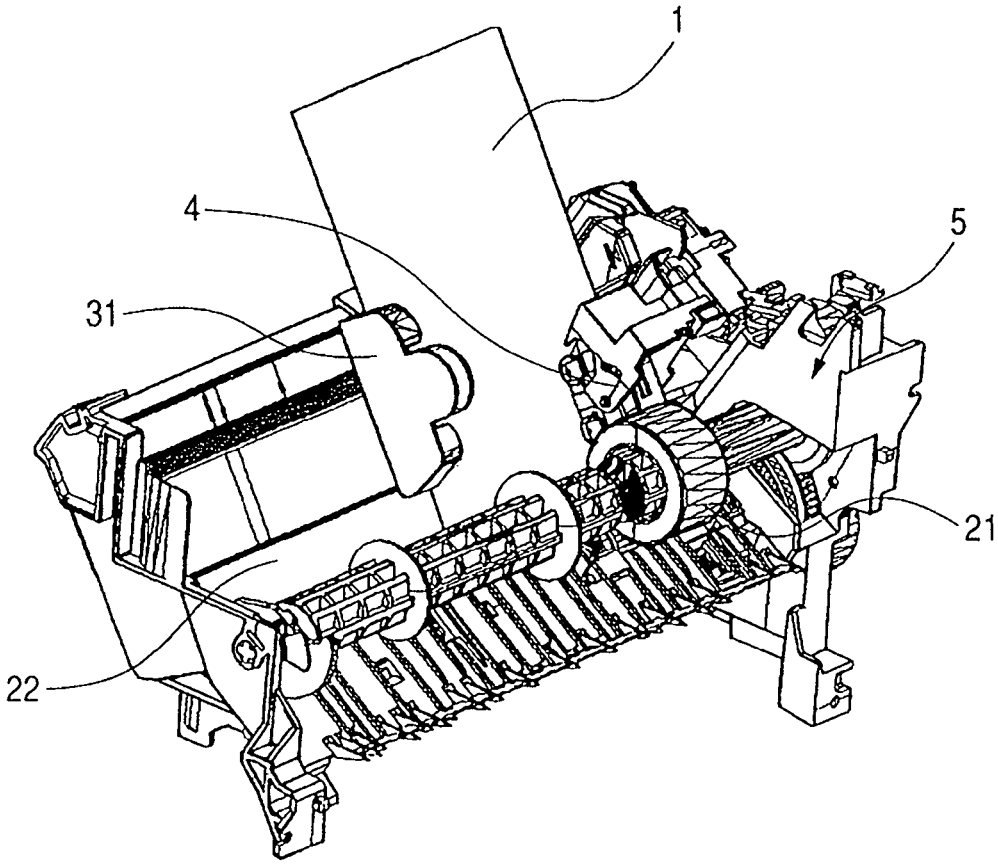
FIG. 3 is a perspective view, seen from front, of a sheet feed portion of the recording apparatus in an embodiment.
Figure 4:
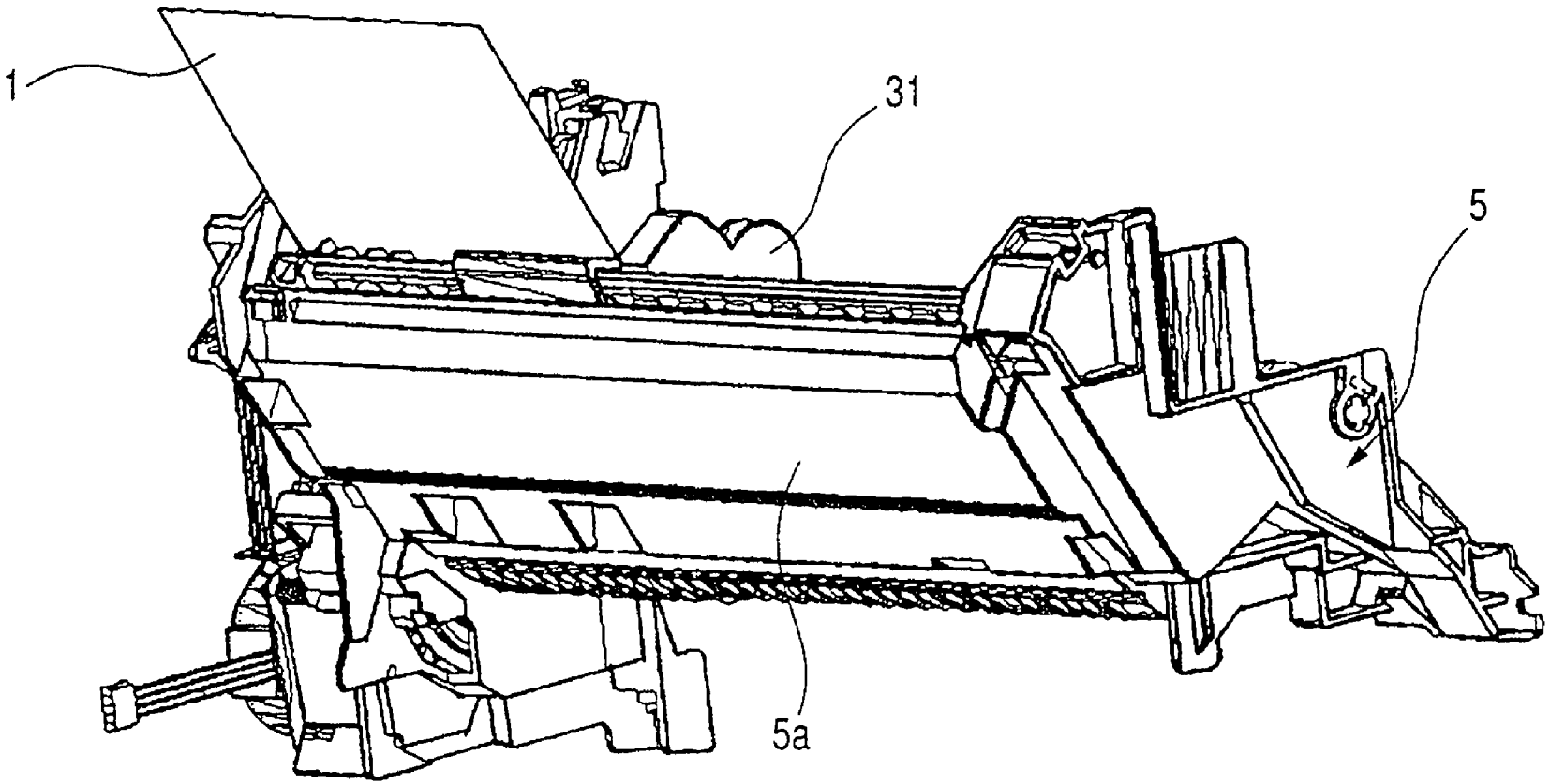
FIG. 4 is a perspective view, seen from rear, of a sheet feed portion of the recording apparatus in an embodiment.
Figure 5:
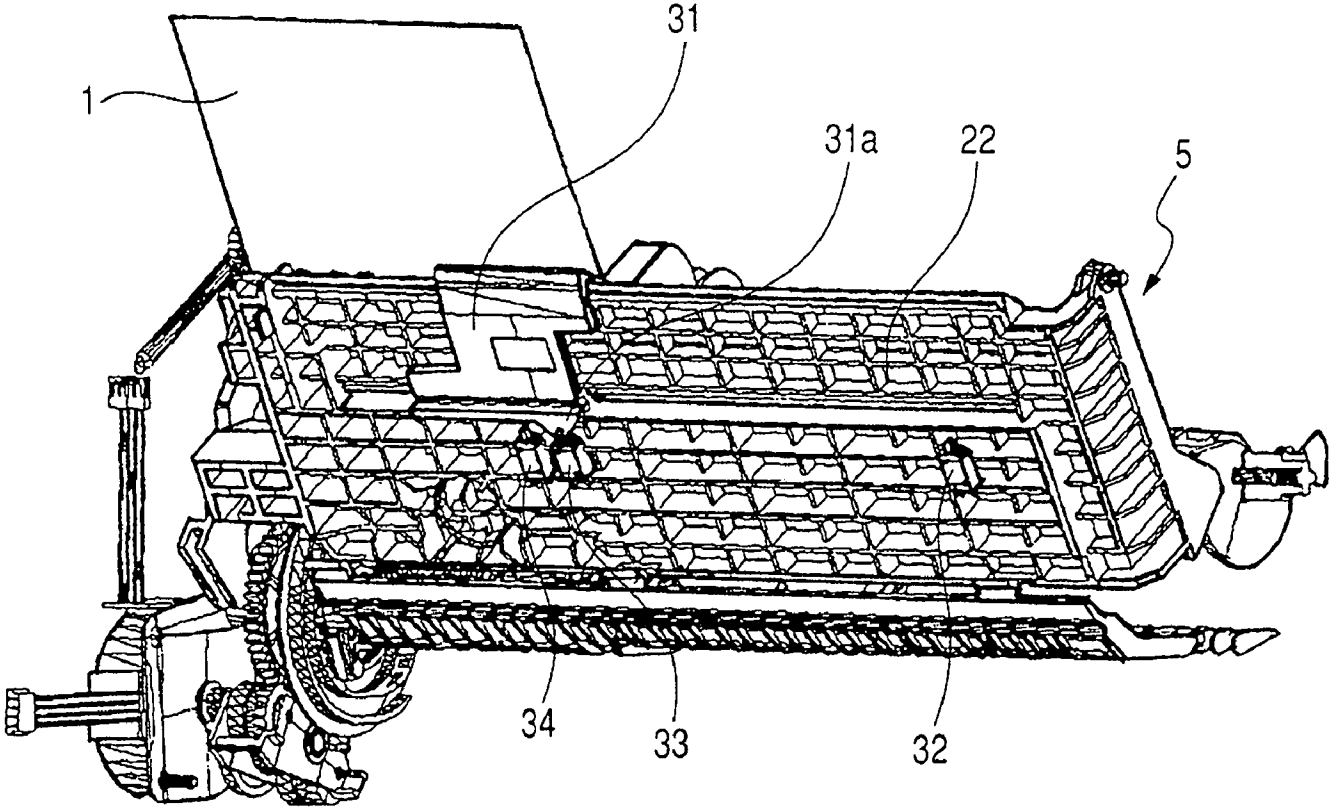
FIG. 5 is a perspective view, seen from rear and shown without a rear cover, showing a state of the sheet feeding portion, with a postcard thereon, of the recording apparatus in an embodiment.
Figure 6:
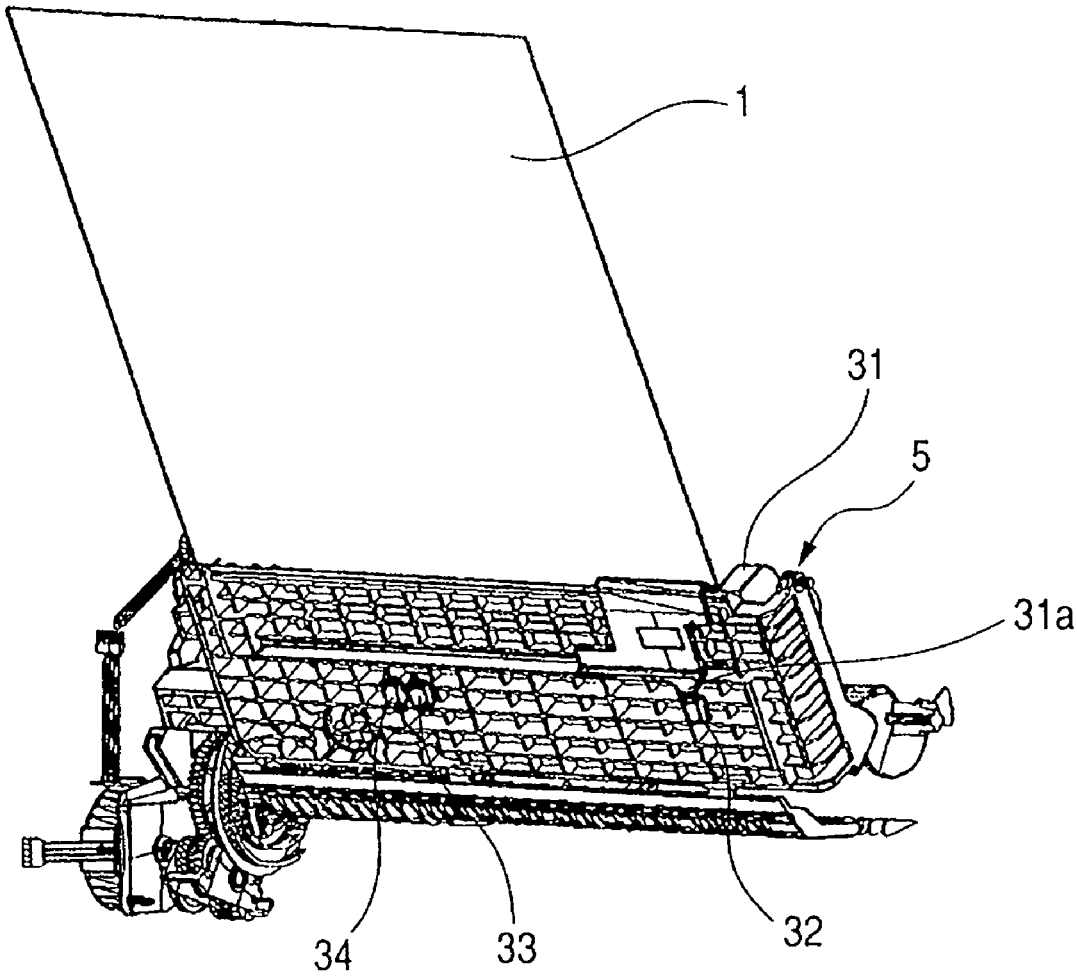
FIG. 6 is a perspective view, seen from rear and shown without a rear cover, showing a state of the sheet feeding portion, with an A4-sized sheet thereon, of the recording apparatus in an embodiment.

FIG. 3 is a perspective view, seen from front, of a sheet feed portion of the recording apparatus in an embodiment; FIG. 4 is a perspective view, seen from rear, of a sheet feed portion of the recording apparatus in an embodiment; FIG. 5 is a perspective view, seen from rear and shown without a rear cover, showing a state of the sheet feeding portion, with a postcard thereon, of the recording apparatus in an embodiment; and FIG. 6 is a perspective view, seen from rear and shown without a rear cover, showing a state of the sheet feeding portion, with an A4-sized sheet thereon, of the recording apparatus in an embodiment. Now first detection means for detecting the width dimension of the recording medium will be explained with reference to FIGS. 3 to 6. Now referring to FIGS. 3 to 6, when a sheet feed roller rotates in a state where a recording medium 1, placed on a pressure plate 22, is pressed to the sheet feeding roller 21 by an urging force of a pressure plate spring, the recording medium is separated, from an uppermost medium, one by one and fed toward a recording portion 2. In a state where a sheet feeding portion 5 is assembled in a main body of the apparatus, a rear side of the sheet feeding portion is covered by a rear cover 5*a* as shown in FIG. 4.

In a rear side of the pressure plate 22, positions sensors 32, 33, 34 are provided in three positions along the width direction, and each of the positions sensors 32, 33 and 34 is turned on when contacted by a protruding portion 31*a* by a movement of the movable side guide 31, and is turned off when not contacted. Thus, when a postcard-sized recording medium is stacked, the lateral edge thereof is impinged on, as shown in FIG. 5, by the movable side guide 31 whereby the protruding portion 31*a* contacts and turns on the middle-positioned sensor 33. It is thus detected that the movable side guide 31 is positioned at the position sensor 33 and that the recording medium in the stacking portion has a postcard size.

Also when an A4-sized recording medium is stacked, the lateral edge thereof is impinged on, as shown in FIG. 6, by the movable side guide 31 whereby the protruding portion 31*a* contacts and turns on the right-side sensor 32. It is thus detected that the movable side guide 31 is positioned at the position sensor 32 and that the recording medium in the stacking portion has an A4 size. Similarly, the position sensor 34, provided at the left side in the illustration is in such a position as to detect an L-sized recording medium even smaller than the postcard.

Figure 8:
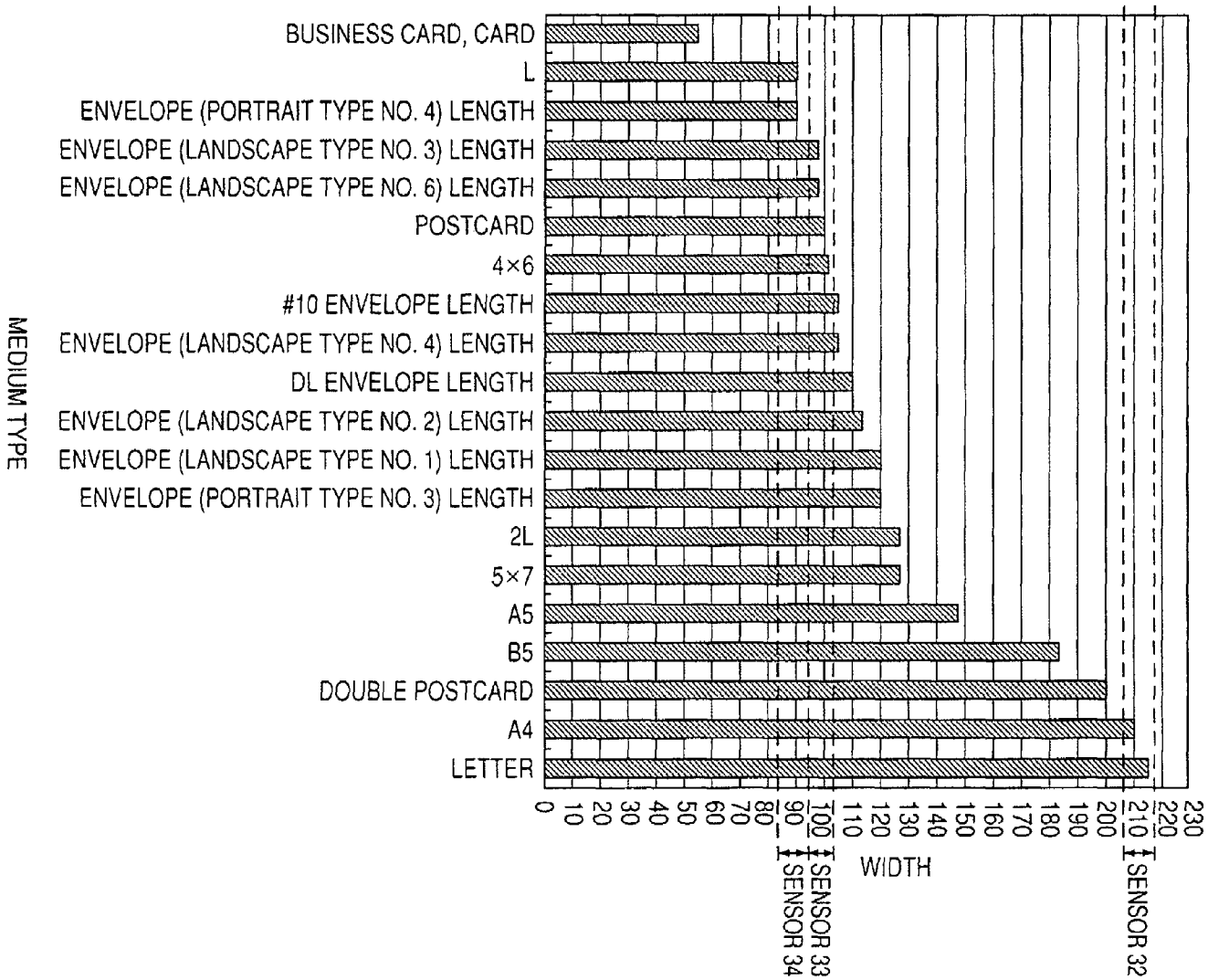
FIG. 8 is a graph showing an example showing width dimensions of the recording medium, on types shown in FIG. 7.

FIG. 7 is a table showing an example of a relationship among a size, a surface state, and a type of the recording medium; and FIG. 8 is a graph showing an example showing width dimensions of the recording medium, on types shown in FIG. 7. The table in FIG. 7 and the graph in FIG. 8 constitute an example of a combination table, of the size and the surface characteristics of the recording media. FIGS. 7 and 8 describe types and width dimensions of frequently used media, in the order of width dimension. In the table shown in FIG. 7, in addition to the width and the length of each recording media, surface state thereof is classified in four categories of plain paper, coated paper, glossy paper and OHP (transparency) sheet, and a black mark is attached to a corresponding category. The table also shows detection states by the position sensors 32, 33, 34 explained above.

FIG. 8 shows the table in FIG. 7 as a graph, indicating the type of the recording medium in the abscissa and the width dimension thereof in the ordinate. The ordinate also indicates detection ranges of the position sensors 32, 33, 34. As shown in FIG. 8, the widths of the recording media are distributed continuously, and the width of each recording medium includes a tolerance of about ±1.5-2.0 mm. Also the movable side guide is to be manipulated by the user, and it is impossible or difficult to exactly press it, without a gap, to the lateral edge of the recording media, and a certain gap (for example about 1 mm or less) is usually formed.

Also a measuring system for detecting the width dimension of the recording medium involves accumulated tolerances in the manufacture, leading to a larger error. For example, when the position sensor 34 is turned on at a position close to the width dimension of 89-90 mm, the information thereof alone is unable to discriminate an "L" size and an "envelope (portrait type No. 4)". This is because the width dimension of the recording medium includes a fluctuation in the manufacture, even if the measuring system is capable of detecting that the movable side guide is exactly positioned at 89 mm. It is therefore difficult, by merely measuring the position of the movable side guide 31, to exactly specify the size (width dimension) of the recording medium.

The present embodiment provides a recording apparatus capable of solving such technical difficulties. More specifically, the present embodiment is to provide a recording apparatus capable of an exact identification (discrimination) of the type of the recording medium, by utilizing the information on the width dimension of the recording medium obtained by the position sensors 32, 33, 34 and the information on the surface state of the recording medium, obtained by the sheet type sensor 4, in combination. The present embodiment is capable, for example in the aforementioned case, of exactly discriminating an "L" size and an "envelope (portrait type No. 4)".

FIG. 8 shows, on the ordinate, width ranges of the recording medium in which the position sensors 32, 33, 34 are respectively turned on. Thus, in the present embodiment, the width dimension of the recording medium can be discriminated in four groups, according to the output states (on/off states) of the position sensors 32, 33, 34, as shown in FIG. 7. FIG. 7 shows these groups by A, B, C and D and show results of discrimination into these four groups. In the present embodiment, the position sensors for identifying the width dimension are provided in three positions, but the number and the positions of the position sensors are not limited to such example and may be selected arbitrarily.

Also the method of detecting the width dimension is not limited to a method of providing switches at predetermined positions as in the present embodiment. For example it is possible to form an electric resistance member along the width direction, in such a manner that an electrical resistance varies according to the position of the movable side guide 31, and to detect the position in continuous manner by detecting the electrical resistance, and still other methods are also employable.

Figure 9:
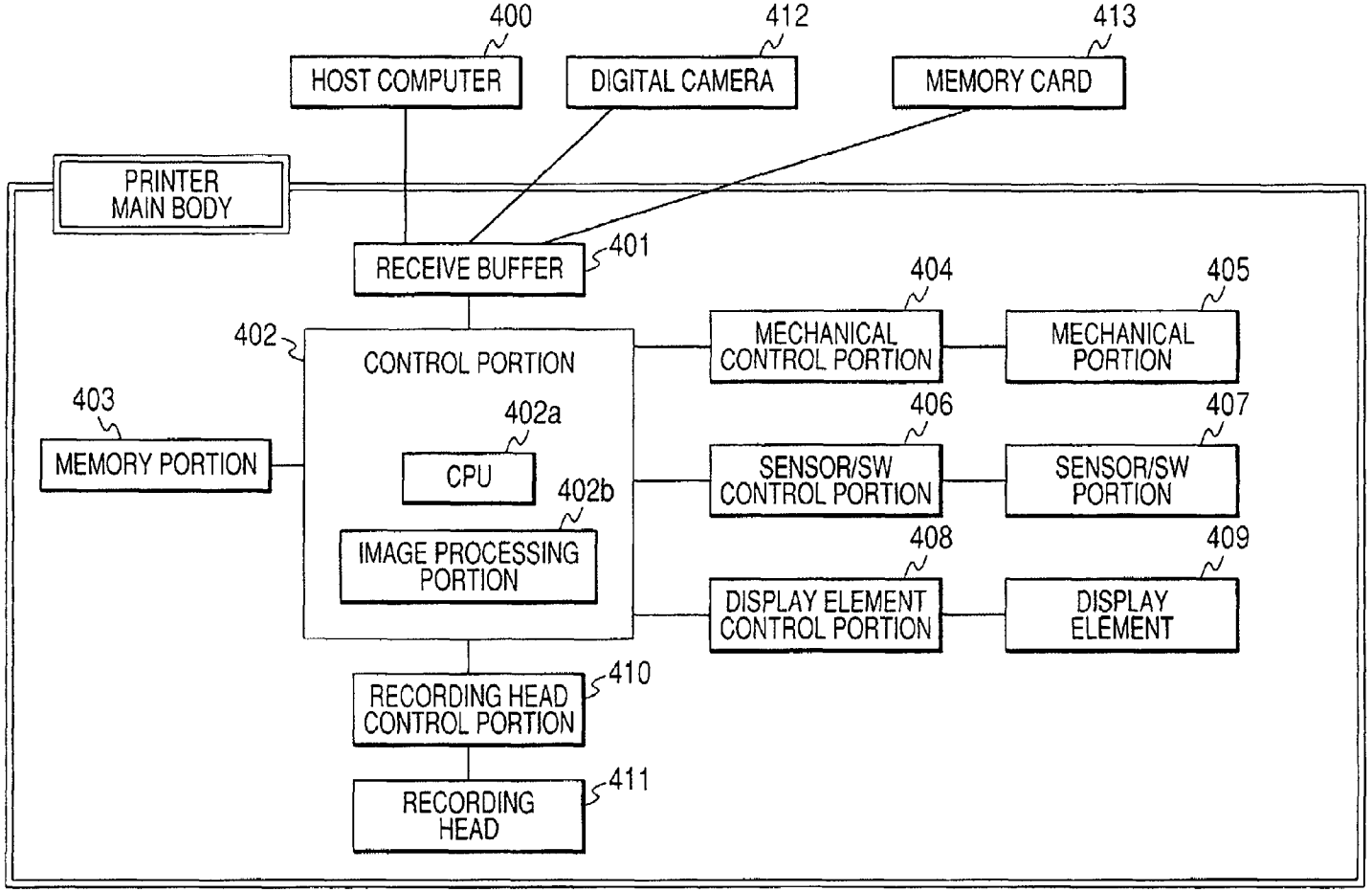
FIG. 9 is a block diagram showing a control system of the recording apparatus in an embodiment.

FIG. 9 is a block diagram showing a control system of the recording embodying the invention, wherein a recording apparatus (main body of the printer) is connectable with a host computer 400 and, receiving a command signal and image data to be recorded from the host computer, can record an image based on such image data. The image data (image information) includes various recording information such as characters and symbols. Also the recording apparatus returns, to the host computer 400, information for confirming whether the data are property transferred and information indicating the operation status of the recording apparatus.

The image data may be fetched, in addition to the host computer 400, from a directly connected digital camera 412 or a memory card 413. It is possible to connect all these at the same time or to connect one only of these, and a wireless connection is also possible. The recording data (image data) received from the host computer 400, the digital camera 412, the memory card 413 etc. are supplied to a reception buffer 401 of the recording apparatus. The recording apparatus includes a control portion 402, containing a CPU 402*a* for integrally controlling a recording operation based on the data supplied to the reception buffer.

The control portion 402 also has an image processing portion 402*b*, for processes such as a processing on the image data entered into the reception buffer 401, a thawing (expand) of compressed image data, and a generation of recording data by detecting a boundary and a blank between different ink colors. The control portion 402 is connected to a memory portion 403, constituted of a RAM (random access memory) for temporarily storing the received image data and the like. The control portion is connected also to control portions of various units.

Such control portions of various units will be explained below. A mechanical control portion 404 controls and drives a mechanical portion 405 such as a carriage motor and an LF motor. A sensor/SW control portion 406 processes signals from a sensor/SW (switch) portion 407 including various sensors such as the sheet type sensor 4 and the position sensors 32, 33, 34. A display device control portion 408 controls a display device portion 409 including an LED and a liquid crystal display device in the display panels. A recording head control portion 410 controls a recording head 111 constituting recording means. These control portions are operated by commands from the control portion 402, and send feedback signals thereto whenever necessary. For example, the recording head control portion 410 sends temperature information, indicating the state of the recording head 411, and the like to the control portion 402.

It is possible, by the output information from the sensor/SW portion 407 including the sheet type sensor 4 and the position sensors 32, 33, 34, to discriminate the size and the surface state of the recording medium processed in the main body of the recording apparatus, and to select and execute an optimum recording method and an optimum recording operation based on the result of such discrimination. It is also possible to transmit the information on the size and the surface state of the recording medium to the host computer and to process and discriminate it in a driver software of the host computer, and to transmit image data for an optimum recording method and an optimum recording operation.

Figure 10:
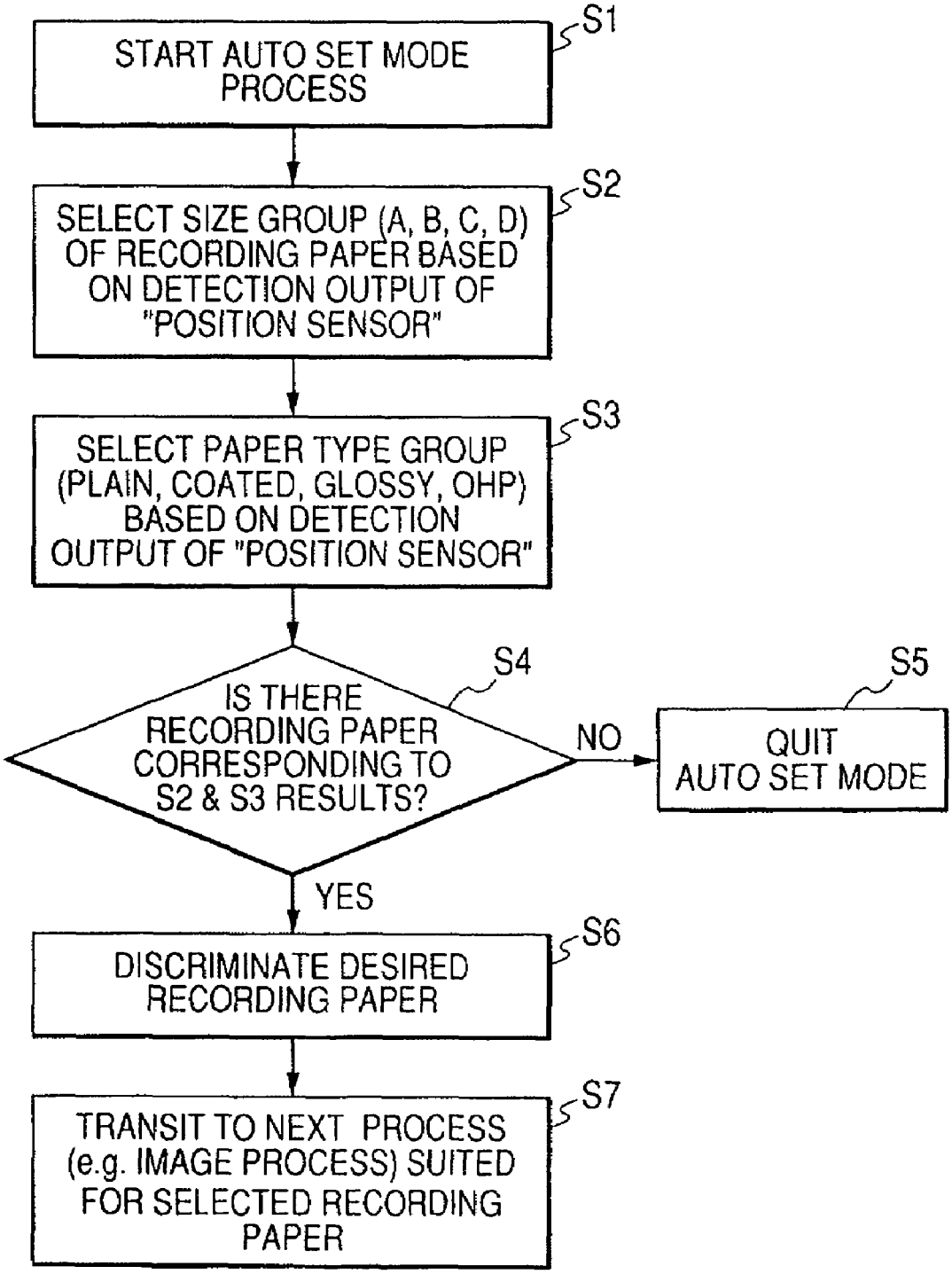
FIG. 10 is a flow chart showing a process executed by the recording apparatus in an embodiment.

FIG. 10 is a flow chart showing operations of a recording apparatus embodying the present invention. In FIG. 10, a step S1 initiates a recording process in an auto setting mode. A step S2 discriminates, based on output information from the position sensors 32, 33, 34, one of the groups A, B, C and D shown in FIG. 7 to which the size of the recording medium, such as a recording sheet, belongs. Then a step S3 discriminates, based on the output information from the sheet type sensor 4, one of the groups of plain paper, coated paper, glossy paper and OHP to which the surface characteristics of the recording medium belong.

The present embodiment explains a case of utilizing four groups in the step S2 and four groups in the step S3, but such groupings may be made finer if necessary, and such finer grouping may be employed in either one or both of such grouping operations. Such finer grouping allows to realize a system capable of discrimination of even higher definition. Then a step S4 checks, based on the results of S2 and S3, whether a corresponding recording medium is present.

In case the corresponding recording medium is absent, the sequence proceeds to a step S5 to quit the auto setting mode, and to display a message, requesting that the user executes a manual setting. On the other hand, when a corresponding recording medium is present, the sequence proceeds to a step S6 to discriminate the corresponding recording medium, and then a step S7 shifts to a next process for executing a process, such as an image processing, matching the size and the surface characteristic (surface state) of the selected recording medium, whereupon the sequence is terminated.

In the embodiment explained above, a recording apparatus for executing a recording operation on a recording medium by recording means based on recording information is so constructed to include sheet feed means 21 which feeds recording media 1 in a stacking portion 22, first detection means 32, 33, 34 which detect a width dimension of the recording medium in the stacking portion, second detection means 4 which detects surface characteristic of the recording medium in the stacking portion, and discrimination means which discriminates the type of the recording medium, based on the detection results of the first and second detection means.

In the structure above, the discrimination means includes first discrimination means which discriminates one of plural groups of the width dimension to which the width dimension of the recording medium 1, detected by the first detection means 32, 33, 34, belongs, second discrimination means which discriminates one of plural groups of the surface characteristics to which the surface characteristics of the recording medium, detected by the second detection means 4, belongs, and third discrimination means which discriminates a type of the recording medium based on the results of discrimination by the first and second discrimination means.

Also in the structure above, the discrimination means includes first discrimination means which discriminates one of plural groups of the width dimension to which the width dimension of the recording medium 1, detected by the first detection means 32, 33, 34, belongs, second discrimination means which discriminates one of plural groups of the surface characteristics to which the surface characteristic of the recording medium, detected by the second detection means 4, belongs, a combination table of a size of the recording medium and surface characteristics thereof, and fourth discrimination means which discriminates a type of the recording medium by a comparison of the results of discrimination by the first and second discrimination means with the combination table.

Therefore, in the embodiments described above, the first detection means 32, 33, 34 are provided to discriminate the width dimension of the recording medium, and information, obtained therefrom in combination with the second detection means 4 for detecting the surface characteristic (surface state) of the recording medium, is compared with a list of preregistered types of the recording media to compliment the discriminating ability by the size or the type only of the recording medium, thereby enabling an exact and finely divided discrimination of "type and size of recording medium". In this manner, it is rendered possible, in an inexpensive structure, to automate the sheet type setting by the user thereby avoiding an operation error in such sheet type setting operation.

The foregoing embodiment has been explained, as an example, by an ink jet recording apparatus for executing a recording operation by discharging ink from a discharge port, but the present invention is likewise applicable and exerts similar effects in any recording method such as a thermal transfer recording, a thermal recording, a laser beam recording, a wire-dot recording and the like. Also the present invention is likewise applicable and exerts similar effects in any type of recording operation, such as a serial type recording apparatus utilizing recording means which reciprocates along the width direction of the recording medium or a line type recording apparatus utilizing for example a full-line head.

Furthermore, the present invention is likewise applicable and exerts similar effects regardless of a structure or a number of recording means (recording head). Further, the present invention is likewise applicable and exerts similar effects not only in an independent recording apparatus but also in a system utilizing a recording apparatus, such as a composite apparatus combined for example with an image pickup apparatus or an input/output apparatus of a computer system or the like. Particularly in case of an ink jet recording apparatus, the present invention is likewise applicable and exerts similar effects in an apparatus utilizing single recording means, an apparatus utilizing plural recording means employing inks of different colors, an apparatus utilizing plural recording means employing inks of different densities in a same color, or a combined apparatus thereof, or a recording apparatus in which the recording means is directly reciprocated without a carriage.

Thus the embodiments of the present invention provides a recording apparatus and a recording method capable, in a simple and inexpensive structure, of automatically discriminating the sheet type and, through such automated specifying of the type of recording medium, avoiding an operation error in such sheet type setting operation.

This application claims priority from Japanese Patent Application No. 2005-166675 filed on Jun. 7, 2005, which is hereby incorporated by reference herein.

What is claimed is:

1. A recording apparatus for executing a recording operation on a sheet, comprising:

a stacking portion that is capable of stacking the sheet thereon;

a movable guide that restricts a position of the sheet stacked on said stacking portion in a direction of a width dimension of the sheet;

a first detection unit that detects a position of said movable guide in the direction of the width dimension;

a second detection unit that detects a surface characteristic of the sheet;

a data table having information about a plurality of sheet types, each of the plurality of sheet types having width information, indicating a corresponding sheet width, and surface information, indicating a corresponding plurality of surface characteristics, the plurality of sheet types being categorized into a first set of groups, based on the width dimension, and a second set of groups, based on the surface characteristic; and a discrimination unit that (i) determines a group of sheet types to which the sheet belongs from the first set of groups, based on the width dimension of the sheet detected by said detection unit, (ii) determines a group of sheet types to which the sheet belongs from the second set of groups, based on the surface characteristic detected by said second detection unit, and (iii) discriminates the type of sheet based on the determined groups.

2. The recording apparatus according to claim 1, further comprising a control unit which changes a condition of the recording operation, according to a discrimination result by said discrimination unit.

3. The recording apparatus according to claim 1, wherein said first detection unit includes a plurality of sensors provided along the direction of the width dimension, each sensing a part of said movable guide.

4. The recording apparatus according to claim 1, wherein said discrimination unit determines whether a recording sheet is present in the apparatus that corresponds to the discriminated type of sheet.

* * * * *